US006619608B1

(12) United States Patent
Mulvey et al.

(10) Patent No.: US 6,619,608 B1
(45) Date of Patent: Sep. 16, 2003

(54) PROMOTIONAL COASTER

(75) Inventors: Patricia M. Mulvey, Neenah, WI (US); Ronald G. Hagen, Larsen, WI (US)

(73) Assignee: Menasha Corporation, Neenah, WI (US)

( * ) Notice: Subject to any disclaimer, the term of this patent is extended or adjusted under 35 U.S.C. 154(b) by 0 days.

(21) Appl. No.: 10/134,118

(22) Filed: Apr. 25, 2002

(51) Int. Cl.[7] ..... B65D 19/00
(52) U.S. Cl. ..... 248/346.11
(58) Field of Search ..... 248/346.11; 215/394

(56) References Cited

U.S. PATENT DOCUMENTS 2,598,019 A * 5/1952 Rosenthal et al. ..... 185/27
3,040,472 A * 6/1962 Miller ..... 248/346.11
3,188,040 A * 6/1965 Eichler ..... 215/393
5,018,695 A * 5/1991 Bishop ..... 248/146
5,024,014 A 6/1991 Swierczek
5,413,302 A * 5/1995 Ferster ..... 248/154
5,803,454 A * 9/1998 Adell ..... 248/346.11
5,938,162 A * 8/1999 Honjo ..... 248/346.11

FOREIGN PATENT DOCUMENTS

GB 2206275 A * 1/1989
WO WO 95/11610 * 5/1995

* cited by examiner

*Primary Examiner*—Ramon O. Ramirez
(74) *Attorney, Agent, or Firm*—Quarles & Brady LLP

(57) ABSTRACT

A promotional coaster has a promotional panel releasably adhered to a coaster panel. The coaster panel has a liquid absorbing upper face and an opposite lower face, which may be provided by an overlaminate barrier layer, that is adhered to an upper face of the promotional panel. Indicia are printed on either or both panels at the interface between them. Thus, when the two panels are joined the promotional indicia is concealed to be revealed fully only after the promotional panel is separated from the coaster panel, which is facilitated by a lift region where the coaster and promotional panels are not joined. The location of the lift region is identified by indicia on the upper face of the coaster panel. A method of promoting a product with the promotional coaster is also disclosed.

7 Claims, 1 Drawing Sheet

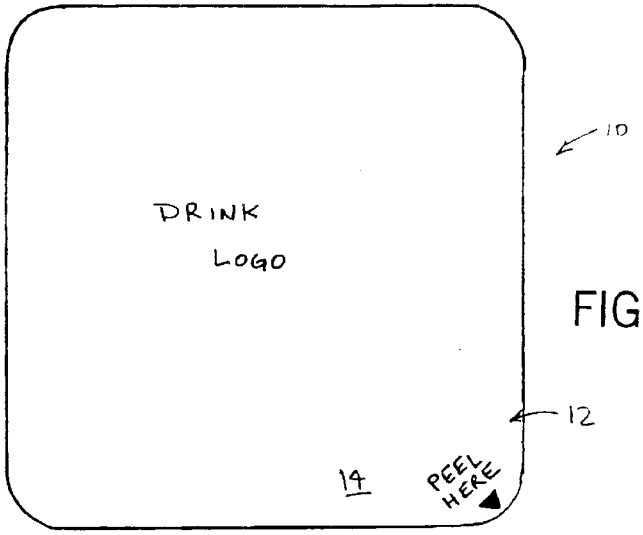
FIG. 1
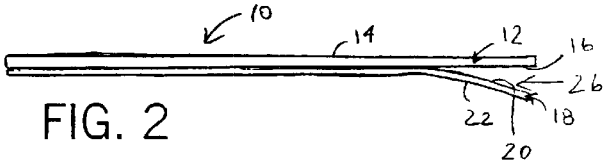
FIG. 2
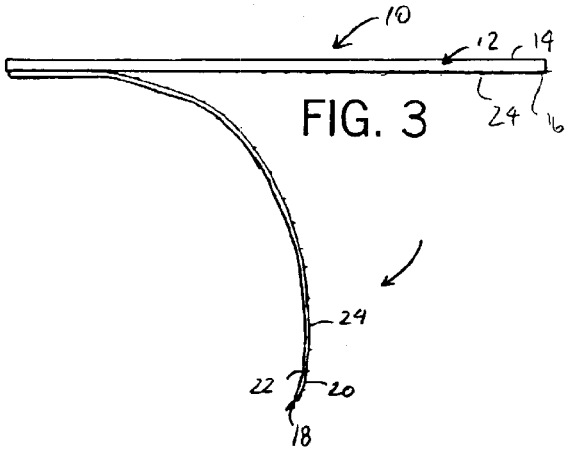
FIG. 3
FIG. 4
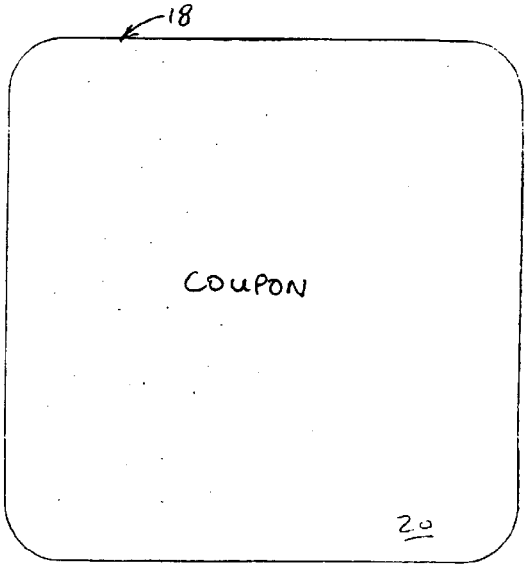
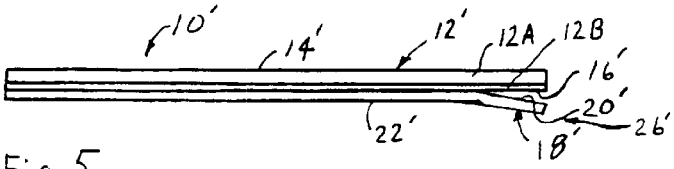
Fig. 5

PROMOTIONAL COASTER

CROSS-REFERENCE TO RELATED APPLICATIONS

Not applicable.

STATEMENT OF FEDERALLY SPONSORED RESEARCH OR DEVELOPMENT

Not applicable.

FIELD OF THE INVENTION

This invention relates to promotional items, such as coupons and game pieces, and in particular to a drink coaster structure.

BACKGROUND OF THE INVENTION

Pads for protecting wood tables and countertops from condensation that can form on glasses and cups containing chilled beverages are well known. Such "coasters" can be made of various materials that isolate the wood from the glass, for example, by absorbing the moisture or providing a water-proof barrier. A pulp-based material, such as paper or cardboard, is a low-cost choice for coasters, particularly when the coasters are intended to be disposable.

In restaurants and bars it is customary to use coasters printed with advertising or promotional graphics and logos of the beverages being served. These coasters are somewhat of an ineffective advertising technique for the beverage producer because ordinarily the coasters are discarded after use because they have been damaged or the indicia has been blurred by absorption of the condensation. Consequently, conventional coasters are not likely to be, retained by the consumer, thus making them unsuitable for more effective marketing techniques, such as coupons. Conventional coasters also do not provide a place to hide information, such as information related to games.

SUMMARY OF THE INVENTION

The present invention provides a combination promotional coaster structure in which promotional indicia is concealed when the structure is used as a coaster and is revealed only after a promotional panel is peeled away, and then removed, from a coaster panel.

Specifically, the invention is a promotional coaster having a coaster panel and a promotional panel. The coaster panel has a liquid absorbing upper face and an opposite lower face. The promotional panel has an upper face releasably joined to the lower face of the coaster panel by a dry residue adhesive, and promotional indicia are provided at the interface between the panels, on either or both of the panels.

In a preferred form, the coaster panel is a pulp material of a greater thickness than the promotional panel and defines a general square area substantially the same size as the promotional panel. The coaster and promotional panels are not joined at a lift region at one corner. Preferably, the coaster panel is printed with product advertisement indicia and an identifier for the lift region on its upper face, and the hidden (upper) face of the promotional panel is printed. The hidden (lower) face of the coaster panel may also be printed, either inside or outside of a barrier layer which may be provided at the under side of the coaster panel. The barrier layer helps to create the releasable bond between the barrier layer and the promotional panel, and also helps isolate the promotional panel from moisture absorbed from the drink.

A method of promoting a product using the promotional coaster is also disclosed. Specifically, the method includes delivering a coaster to a prospective customer in which the coaster has at least two separate panels, a first panel having an absorbent upper face so as to absorb liquid under the customer's drink and a second panel being releasably secured to an under face of the first panel. Hidden printed indicia is provided at the interface between the two panels, on one or both of the panels at the interface.

The present invention thus provides an improved marketing tool, particularly for beverage producers. The upper face of the coaster can be used to advertise products to the consumer at the point of purchase, such as restaurants and bars, while providing a peel-off coupon, game piece or other promotional item in the promotional panel that can be retained by the consumer, for example for redemption toward the purchase of more of the advertised product(s). The underside of the coaster panel (either inside or outside of the overlaminate barrier layer, if one is provided) also provides a printable surface for hiding indicia until the panels are separated by the consumer. A dry residue adhesive is preferably used, which leaves no sticky residue on the coupon, and a varnish component applied to the top side of the promotional panel before applying the adhesive acts to seal the top side of the promotional panel, strengthen it and also hinder absorption of liquid from the coaster panel.

The foregoing and other objects and advantages of the invention will appear from the following description. In this description reference is made to the accompanying drawings which form a part hereof and in which there is shown by way of illustration preferred embodiments of the invention. Such embodiments do not necessarily represent the full scope of the invention, however, and reference must be made therefore to the claims for interpreting the scope of the invention.

BRIEF DESCRIPTION OF THE DRAWINGS

FIG. 1 is a top view of the promotional coaster assembly of the present invention;

FIG. 2 is a side view thereof;

FIG. 3 is a side view thereof showing the promotional panel being peeled away from the coaster panel;

FIG. 4 is a top view of the promotional panel separated from the coaster panel and revealing the promotional indicia; and FIG. 5 is a view like FIG. 2, but of an alternate embodiment.

DETAILED DESCRIPTION OF THE PREFERRED EMBODIMENT

Referring to FIGS. 1 and 2, a promotional coaster 10 of the invention has a coaster panel 12 with upper 14 and under 16 faces and a promotional panel 18 with upper 20 and under 22 faces. The panels 12 and 18 are flat, generally 3½ inch square structures having rounded corners. The coaster could, of course, be of any shape. The coaster panel 12 is preferably made of a pulp-based material, for example printable pulp, preferably 100 lb. (approx. 0.020 inches thick). The upper face 14 is suitably rough to receive and absorb condensation from a vessel containing a chilled beverage. The under face 16 of the coaster panel 12 is relatively smooth and non-absorbent of liquids. The promotional panel 18 is preferably a thinner paper, film or card stock (e.g., 0.008 inches thick) and non-absorbent in comparison to the upper face 14 of the coaster panel 12.

The promotional panel 14 is adhered to the coaster panel 12 at an interface between them so as to be releasable at the interface from the coaster panel 12. A dry residue adhesive 24 is used at the interface so that after the panels 12 and 18 are separated, their previously joined faces are non-tacky such that they cannot be adhered together again. The dry residue adhesive is applied to one or both of the coaster panels on face 16 or on the promotional panel upper face 20 over their entire areas, except at a lift region 26 near the lower right hand corner as shown in FIG. 1. This lift region 26 allows the panels 12 and 18 to be apart slightly at one corner so that one of the panels 12 and 18, preferably the promotional panel 18, can be grasped at the corner and peeled away from the other panel, as shown in FIG. 3. In this way, the promotional panel 18 can be separated from the coaster panel 12, as shown in FIG. 4, and kept by the consumer to redeem for the discounted purchase of the product(s) being advertised.

As mentioned, the two panels 12 and 18 are dry release bonded at the faces 16 and 20, respectively, to provide the releasable interface between the two panels. In preparation for bonding, face 20 is first coated with a suitable varnish, such as varnish F67053 from Sun Chemical Corporation of Fort Lee, N.J., and face 16 is coated with a release agent, such as PCF 3512 from Sun Chemical. Following curing of the release agent, a suitable water based adhesive is applied, such as Tyvek 3487 from H. B. Fuller of St. Paul, Minn. In addition to preparing the surface of face 20 for adhesion, the varnish acts to strengthen the promotional panel and provide a water-proof barrier, thus reducing the chance the coupon will be damaged.

The panels 12 and 18 are preferably not transparent and provide four surfaces for printing textual and graphical indicia. The coaster panel upper face 14 can be printed with an advertisement or promotional material relating to the product supported by the coaster, such as an alcoholic beverage, shown in FIG. 1 as "Drink Logo". The upper face 14 is also preferably printed with words and/or symbols identifying the location of the lift region 26, as shown in FIG. 1 as "PEEL HERE" with an arrow. The under face 16 can also be printed with a different indicia such as a public service announcement, for example "Drink Responsibly", or further advertisement such as a corporate logo or mark. The upper face 20 of the promotional panel 14 is printed with the coupon indicia, shown in FIG. 4 as "Coupon", identifying the product(s), the value and any limitations on redemption, as is conventional. The coupon indicia is printed on face 20 so that it is concealed when the device is used as a coaster until the consumer separates and/or removes the promotional panel. Because this face is concealed during use, in addition to, or instead of, a coupon, this face could be printed with indicia related to games, giveaways, contests and other promotional indicia. Finally, the under face 22 of the promotional panel can also be printed with additional indicia such as text and graphics that complement the indicia of the upper face 14 of the coaster panel. Thus, all four faces (two exposed, two hidden) of the coupon 10 can be printed.

FIG. 5 illustrates a variation 10' to the previously described embodiment 10 in which the panel 12' includes the absorbent layer 12A, which is the same as the layer 12 in the embodiment 10, and an overlaminate layer 12B of self wound (self adhesive) polypropylene which is applied to the underside of the layer 12A. All other elements of the coaster 10' are the same as the coaster 10, and are identified with the same reference numeral, plus a prime (') sign.

In the coaster 10', the releasable bond is provided at the interface between the bottom side of the overlaminate 12B and the top of panel 18', in the same manner as described above for the coaster 10. When using the overlaminate 12B, no release agent is applied to the underside of the layer 12A or to the underside of the overlaminate 12B. However, it is still desirable to apply the varnish to the top side of the promotional layer 18', before applying the dry residue adhesive to the top side of the promotional layer 18' over the varnish. After applying the dry residue adhesive over the cured varnish, the panels 12' and 18' are laminated together to create the releasable dry residue bond between the underside of the layer 12B and the top side of the panel 18'. When the panel 18' is removed from the panel 12 by the consumer breaking the releasable bond, the layers 12A and 12B remain laminated together.

The overlaminate layer 12B is useful as a barrier, to prevent the dry residue adhesive which is applied to the top of panel 18' from soaking or wicking into the absorbent layer 12A, so as to create a dry residue bond with the promotional panel 18' without excessive fiber tear. It also helps prevent moisture absorbed from the drink from soaking through to the promotional panel 18'. The overlaminate layer 12B can be applied after printing the bottom side of layer 12A, if the layer 12B is transparent, or can be printed itself, whether or not it is transparent. After the releasable bond at the interface between the two panels is broken, printing on the under face of panel 12 (whether inside of the barrier 12B—printed on the bottom of layer 12A—or on the outside of barrier 12B) and/or on the top face of the panel 18' is visible and highly legible.

Preferably, coasters of the invention are made in line using high speed presses to print and laminate the layers of the coaster, and cut individual coasters from the web of coasters made in line. Coasters of the invention may be made out of wide webs, with several widths of coasters made across the web. Such presses and the operation of them are well known.

The coaster can thus be used to promote a product, for example, by delivering the coaster to a prospective customer with the product, a beverage for example. The coaster panel preferably would be printed with advertising of the product on the absorbent upper face and the upper (or inner), concealed face of the promotional panel and/or coaster panel would be printed with promotional indicia related to the product or its manufacturer. The customer could reveal the promotional indicia by peeling the promotional panel from the coaster panel. The promotional panel being non-absorbent could be retained intact for later use, in the case of a coupon for example, for redemption on the purchase of a product.

The present invention thus provides an improved marketing tool, particularly for beverage producers. The upper face of the coaster can be used to advertise products to the consumer at the point of purchase, such as a restaurant or bar, while providing a peel-off coupon that can be retained by the consumer and redeemed toward the purchase of the advertised product. The dry residue adhesive leaves no sticky residue on the coupon.

An illustrative embodiment of the invention has been described in detail for the purpose of disclosing a practical, operative structure whereby the invention may be practiced advantageously. However, this is intended to be illustrative only, and the novel characteristics of the invention may be incorporated in other structural forms without departing from the scope of the invention. For example, the invention is not limited to the use of paper, any sheet or film material, plastic, metal or other material can be used provided a liquid absorbing layer is present at the upper face of the coaster panel. Accordingly, to apprise the public of the full scope of the: invention, the following claims are made.

What is claimed is:

1. A promotional coaster, comprising:

a coaster panel for supporting a drink having a liquid absorbing upper face and an opposite under face; and a promotional panel having an upper face;

an adhesive releasably bonding the upper face of the promotional panel to the coaster panel under face;

wherein at least one of the coaster and promotional panels is provided with indicia which is visible at the interface when the panels are separated;

wherein at least one of the coaster and the promotional panel is sealed at at least one of the faces at the interface between the coaster and the promotional panel;

wherein the adhesive is a dry residue adhesive; and wherein the panels are separated by breaking the bond of the adhesive at the interface.

2. The promotional coaster of claim 1, wherein the coaster panel includes indicia.

3. The promotional coaster of claim 2, wherein the coaster panel indicia in part identifies the location of a lift region.

4. The promotional coaster of claim 3, wherein the lift region identifier is visible at the coaster panel upper face.

5. The promotional coaster of claim 1, wherein indicia is visible at the upper face of the promotional panel.

6. A promotional coaster, comprising:

a coaster panel for supporting a drink having a liquid absorbing upper face and an opposite under face, wherein the coaster panel has an overlaminate layer at its under face; and a promotional panel having an upper face; and an adhesive releasably bonding the upper face of the promotional panel to the overlaminate layer at an interface between the promotional panel and the overlaminate layer;

wherein at least one of the coaster and promotional panels is provided with indicia which is visible at the interface when the panels are separated; and wherein the panels are separated by breaking the bond of the adhesive at the interface.

7. The promotional coaster of claim 6, wherein the adhesive is a dry residue adhesive.

* * * * *